United States Patent [19]

Kuse

[11] 4,232,112

[45] Nov. 4, 1980

[54] PROCESS FOR TREATING SILVER HALIDE COLOR PHOTOGRAPHIC PHOTOSENSITIVE MATERIAL

[75] Inventor: Satoru Kuse, Hino, Japan

[73] Assignee: Konishiroku Photo Industry Co., Ltd., Tokyo, Japan

[21] Appl. No.: 9,583

[22] Filed: Feb. 5, 1979

[30] Foreign Application Priority Data

Feb. 10, 1978 [JP] Japan ..... 53-14280

[51] Int. Cl.[2] ..... G03C 5/32; G03C 7/16

[52] U.S. Cl. ..... 430/393; 430/377; 430/467; 430/461; 430/486

[58] Field of Search ..... 96/22, 55, 56, 60 BF, 96/66 R; 430/372, 393, 377, 461, 467, 486

[56] References Cited

U.S. PATENT DOCUMENTS 3,236,652 2/1966 Kennard ..... 96/56

3,868,253 2/1975 Marthaler ..... 96/60 BF 3,879,202 4/1975 Yamaguchi ..... 96/60 BF

FOREIGN PATENT DOCUMENTS 1190855 2/1970 United Kingdom ..... 96/60 BF

*Primary Examiner*—Mary F. Downey

*Attorney, Agent, or Firm*—Haseltine, Lake & Waters

[57] ABSTRACT

In a process of developing an imagewise exposed silver halide color photographic photosensitive material with a color developing solution and then bleach-fixing with a bleach-fixing solution, the improvement which comprises adding, to at least one of the color developing solution and the bleach-fixing solution, at least one whitening agent selected from 4,4'-diaminostilbenedisulfonic acid derivatives and at least one additive selected from sulfonic acid derivatives of benzene or naphthalene, optionally containing alkyl or alkenyl groups.

5 Claims, No Drawings

PROCESS FOR TREATING SILVER HALIDE COLOR PHOTOGRAPHIC PHOTOSENSITIVE MATERIAL

This invention relates to a process for treating a silver halide photosensitive material for color photography. More particularly, it relates to a process for preventing some stains on a silver halide color photographic photosensitive material such as color stains on the white portions of the material and stains on the edge portions of same when the photosensitive material is developed with a color developing solution and then bleach-fixed with a bleach-fixing solution.

In the processing of a silver halide photosensitive material for color photography, when a color developing solution and a bleach-fixing solution are used over a long time, their activities are naturally lowered. In order to refresh the solutions, it is customary either to add to the respective solutions a color developing replenisher and a bleach-fixing replenisher or to add to the bleach-fixing solution a bleach-fixing replenisher which is obtained by adding a lacking component or components to an overflowed bleach-fixing solution and feeding the resulting solution to a replenisher composition. By the addition, the component or components lost during the processing and also by the overflow are supplemented.

When a silver halide color photographic photosensitive material is developed with a color developing solution and then fixed with a bleach-fixing solution, it has been frequently experienced that there is developed a color stain such as a red- or brown-colored stain on white portions of the material or a stain appearing on edge portions. Especially when there is used a bleach-fixing solution in which a photosensitive substance such as a silver halide dissolved out from the photosensitive material or a color developing solution is accumulated and which is oxidized such as by aeration in a regeneration process and is thus fatigued, the color stain is developed considerably. A number of reasons why the color stain is developed may be assumed. For instance, it is believed that oxidation products of a color developing agent (e.g. semiquinonediimine, quinonediimine, etc.) are produced in the bleach-fixing solution and react with a coupler of the photosensitive material to form a colorant, thus producing a color stain particularly on the non-exposed portions (white portions). Further, where the bleach-fixing solution is concentrated during the running process, the dissolved-out photosensitive substance, bleach-fixing component and its oxides, and accumulated matters in the color developing solution and their oxides penetrate into the edge portions of the photosensitive material, causing the edge stain. These color and edge stains serve to lower the quality of the photographic image to a considerable extent, thus presenting a serious problem.

In order to solve the problem, there are known several techniques including a technique of preventing the color stain by addition of an alkylamino compound to a bleach-fixing solution (Japanese Pre-Exam Patent Publication No. 51-102640), a technique of preventing the color stain by combination of a certain type of magenta coupler in the photosensitive material with a hardening agent (Japanese Pre-Exam Patent Publication No. 48-71639), and a technique of preventing the color stain by addition of an oxide of a certain amino compound to a bleach-fixing solution (Japanese Post-Exam Patent Publication No. 51-23179).

In recent years, however, there is a tendency that the bleach-fixing solution is repeatedly used by regeneration for reasons of environmental pollution and economy with a reduced supplement or replenisher. That is, the once used bleach-fixing solution is generally regenerated at a regeneration rate (the term "regeneration rate" used herein is intended to mean a ratio of an amount of an overflowed bleach-fixing solution regenerated as a bleach-fixing replenisher to the total amount of the overflowed bleach-fixing solution) as high as 80% or more. Because of the tendency of the reduced supplement, the components of the color developing solution and the matter dissolved out from the photosensitive material are accumulated in the bleach-fixing solution is increased amounts and the pH of the bleach-fixing solution is raised, thereby causing the color stain to a more considerable extent.

When the photosensitive material is processed at a high temperature above 30° C. by the recent trend of speed-up of the photographic processing, there is a tendency that an increased degree of color stain appears on white portions of the material together with a greater degree of stain in the edge portions. However, the aforementioned prior art methods can not prevent the development or formation of the color stain resulting from both the reduced supplement of replenisher and the high temperature and high speed processing.

It is accordingly an object of the present invention to provide a process for treating a silver halide color photographic photosensitive material which can effectively prevent color staining on white portions of the photosensitive material or staining in the edge portions even under such severe conditions as discussed above.

We have made an extensive study of photographic processing and, as a result, found that the above object can be achieved by a process in which a silver halide color photographic photosensitive material is developed wth a color developing solution and then bleach-fixed with a bleach-fixing solution, the process comprising adding, to at least one of the color developing solution and the bleach-fixing solution, at least one whitening agent selected from 4,4'-diaminostilbenedisulfonic acid derivatives in an amount of 0.3–10 g/l of the solution and at least one member selected from compounds expressed by the following general formulae (I) and (II):

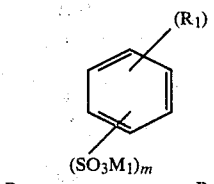

(I)

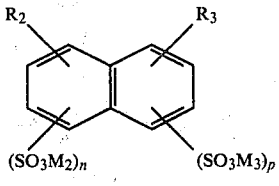

(II)

wherein $R_1$, $R_2$ and $R_3$ are individually hydrogen, an alkyl group (which is preferred to be an alkyl group containing 1–4 carbon atoms such as methyl, ethyl, propyl, butyl, or the like) or an alkenyl group (such as vinyl), $M_1$, $M_2$ and $M_3$ are individually hydrogen or a cation such as of sodium, potassium, lithium or ammonium), l and m are individually an integer of 1 to 3 inclusive, and n and p are individually an integer to satisfy the following inequality that is $1 \geqq n+p \geqq 8$.

It should be noted that, in the above formula (I), all the $R_1$ groups are not necessarily the same in the case of l=2 or 3.

The 4,4'-diaminostilbenedisulfonic acid derivatives serving as the whitening agent useful in the present invention are those described, for example, in "Handbook of Dyestuffs" compiled by the Institute of Organic and Synthetic Chemistry (published by Maruzen Co., Ltd., on July 20, 1960), pages 817 to 836 and U.S. Pat. No. 3,269,840.

Preferably mentioned are compounds expressed by the following general formula (III)

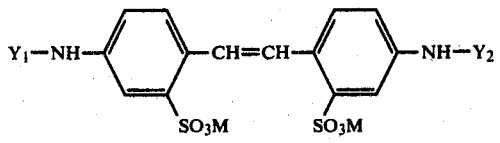

(III)

wherein $Y_1$ and $Y_2$ are individually a group

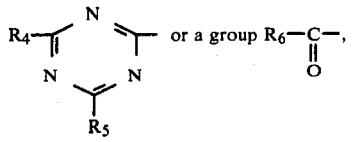

in which $R_4$, $R_5$ and $R_6$ are individually a hydroxyl group, a halogen atom such as chlorine, bromine or the like, a morpholino group, an alkoxy group including alkoxy and substituted alkoxy (such as, for example, methoxy, ethoxy, methoxyethoxy or the like), an aryloxy group including aryloxy and substituted aryloxy (such as phenoxy, p-sulfophenoxy or the like), an alkyl group including alkyl and substituted alkyl (such as methyl, ethyl or the like), an aryl group including aryl and substituted aryl (such as phenyl, methoxyphenyl or the like), an amino group, an alkylamino group including alkylamino and substituted alkylamino (such as methylamino, ethylamino, propylamino, dimethylamino, cyclohexylamino, β-hydroxyethylamino, di(β-hydroxyethyl)amino, β-sulfoethylamino, N-(β-sulfoethyl)-N'-methylamino, N-(β-hydroxyethyl)-N'-methylamino or the like), an arylamino including arylamino and substituted arylamino (such as anilino, o-, or m- and p-sulfoanilino, o-, m- and p-chloroanilino, o-, m- and p-toluidino, o-, m- and p-carboxyanilino, o-, m- and p-hydroxyanilino, sulfonaphthylamino, o-, m- and p-aminoanilino, o-, m- and p-anisidino or the like).

Specific examples of such derivatives are as follows.

A-1

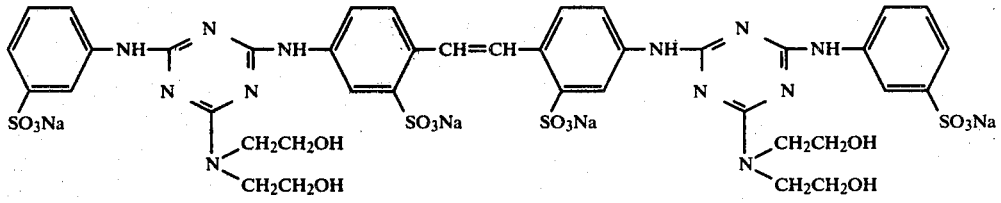

A-2

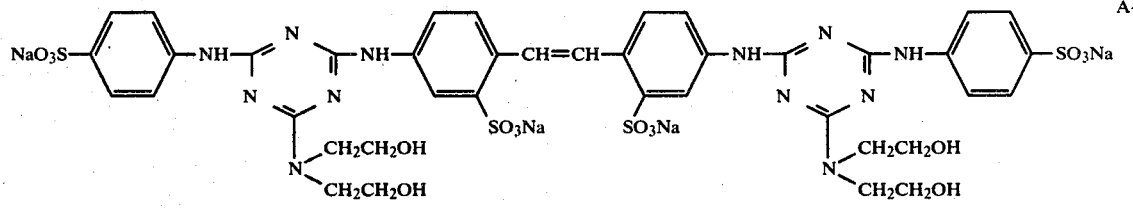

A-3

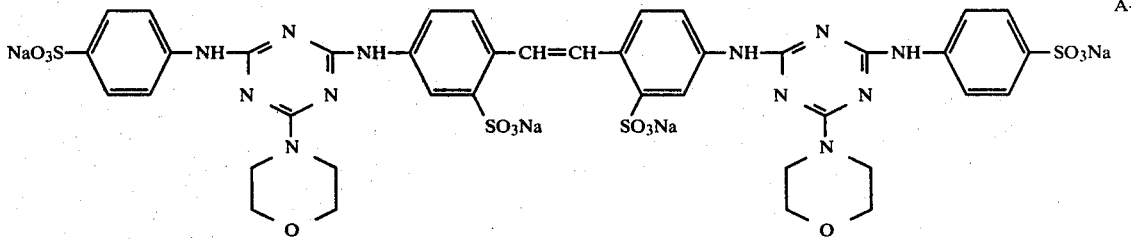

-continued
A-4
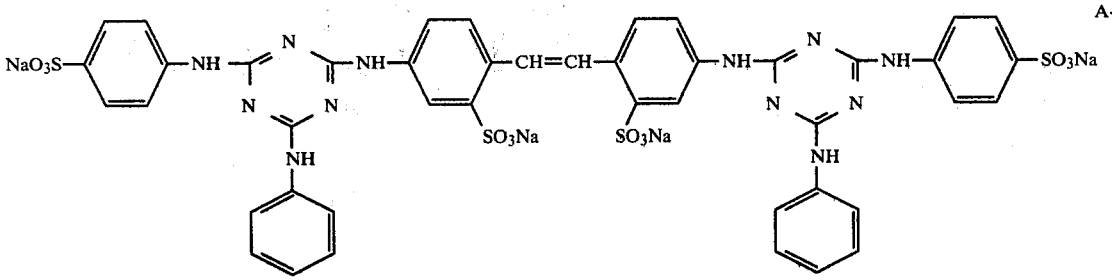
A-5
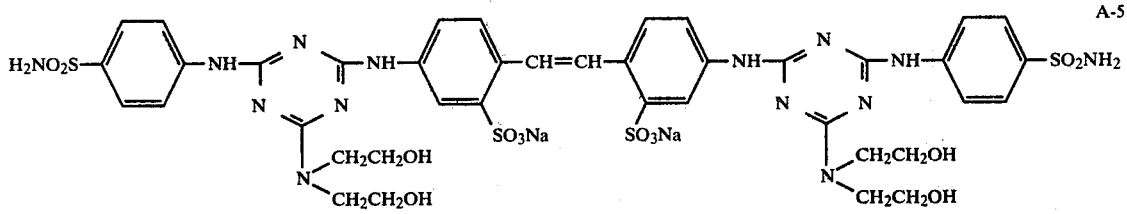
A-6
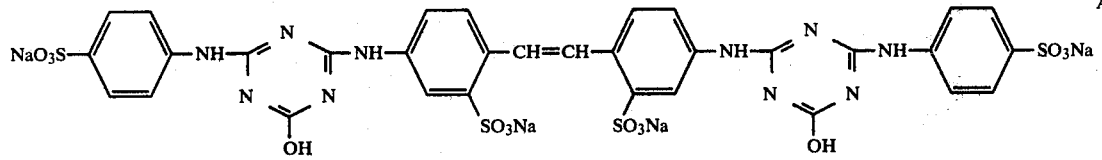
A-7
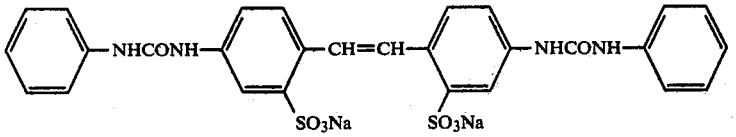
A-8
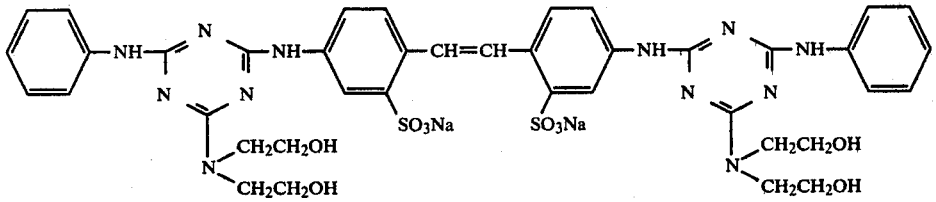
A-9
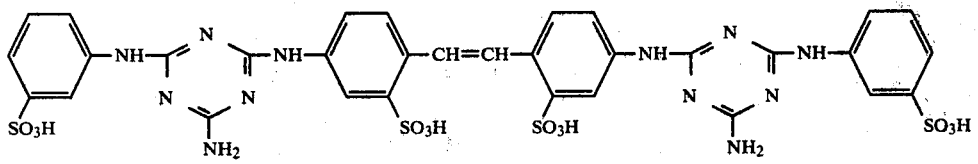
A-10
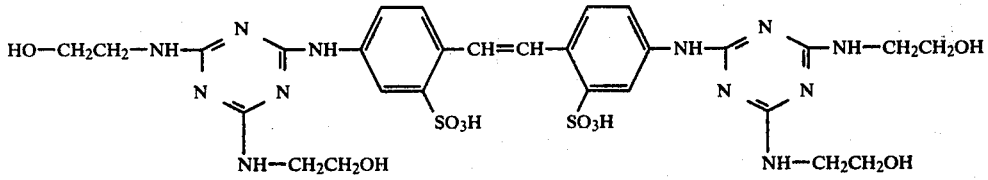
A-11
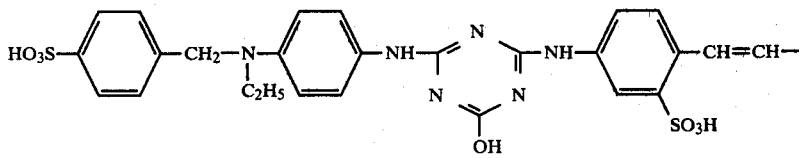
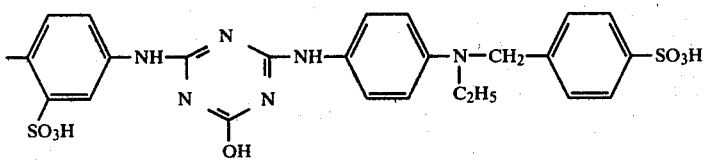

-continued
A-12
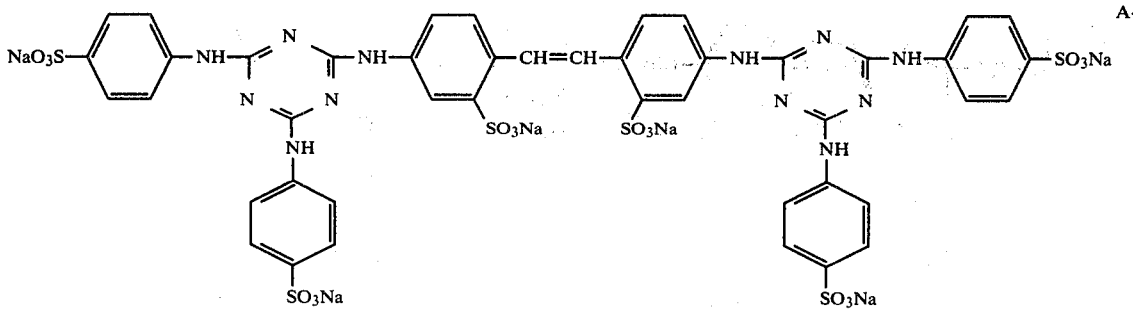
A-13
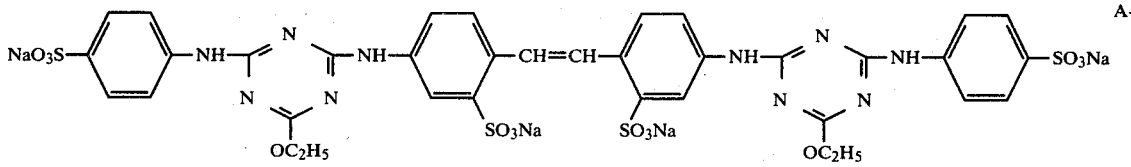
A-14
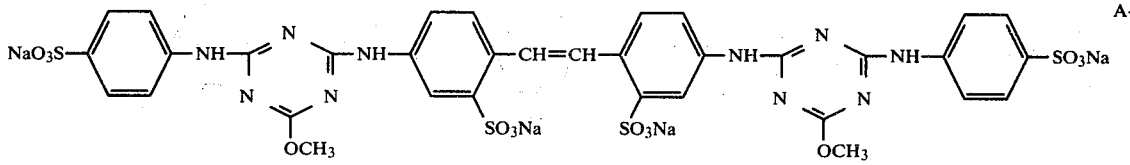
A-15
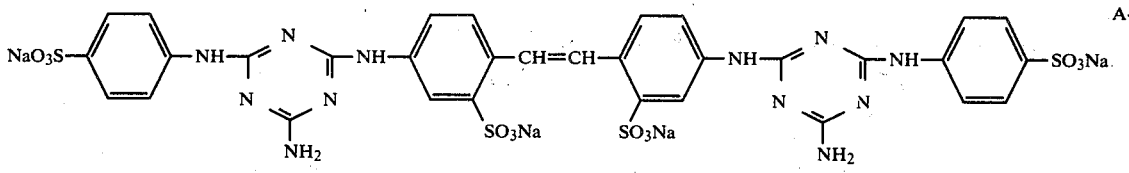
A-16
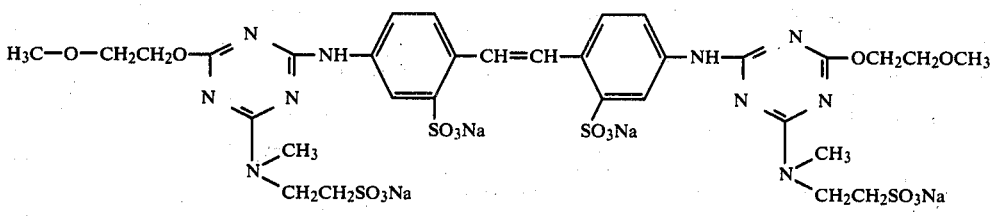
A-17
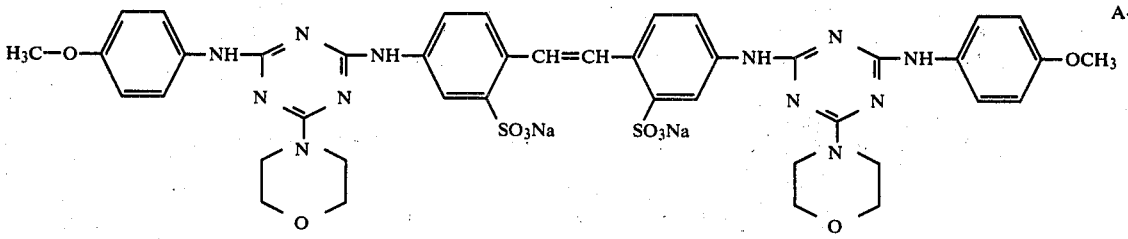
A-18
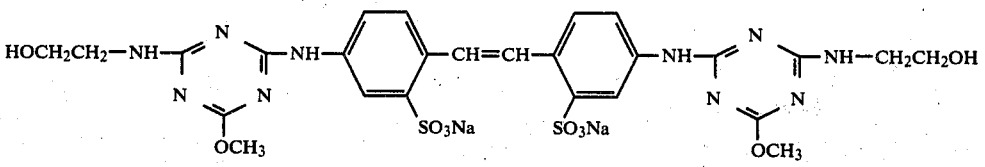
A-19
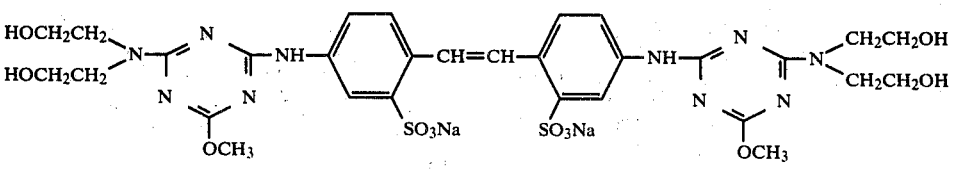

-continued
A-20
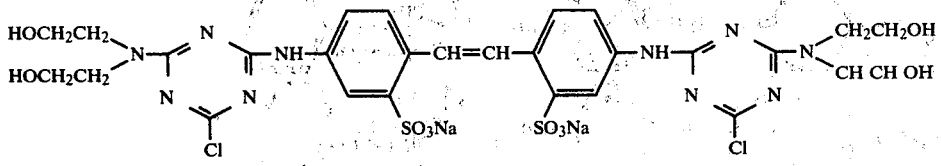
A-21
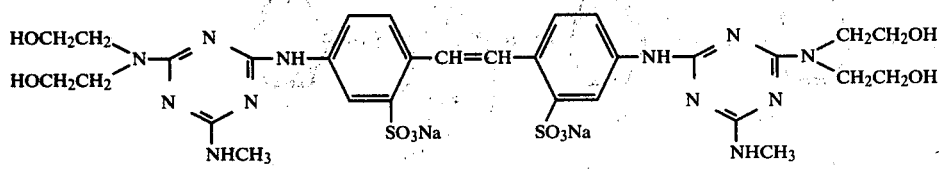
A-22
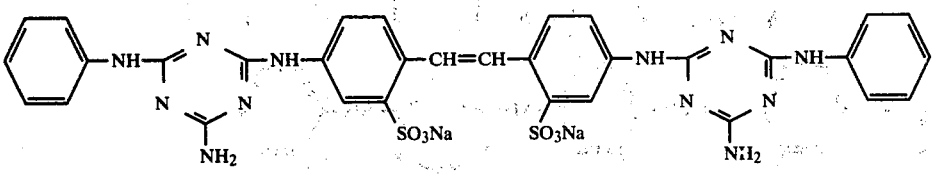
A-23
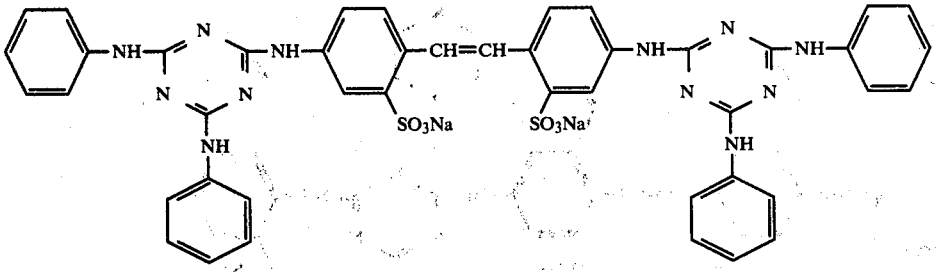
A-24
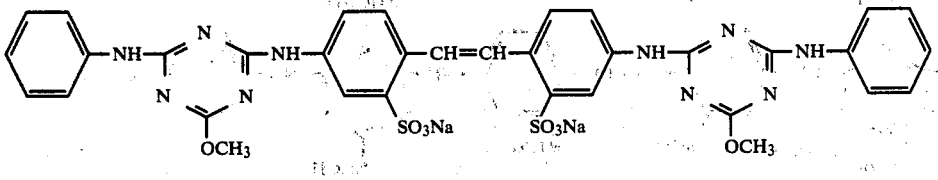
A-25
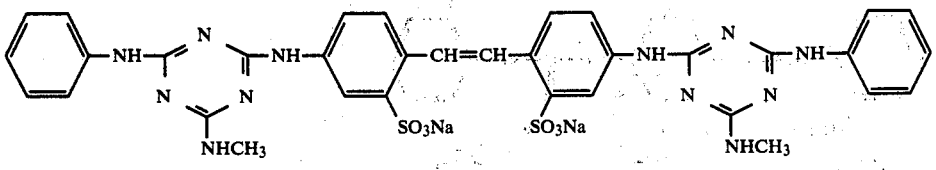
A-26
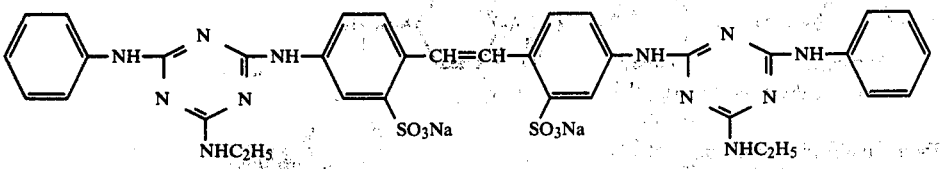
A-27
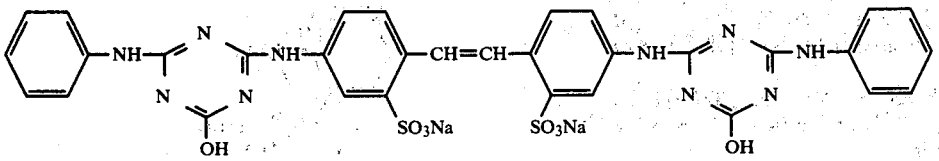
A-28
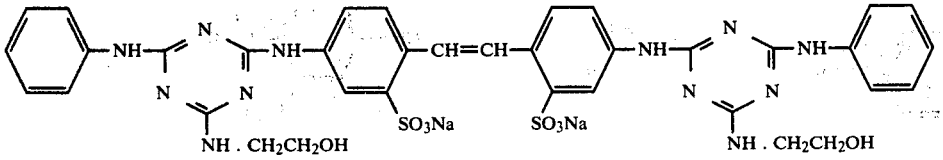

-continued

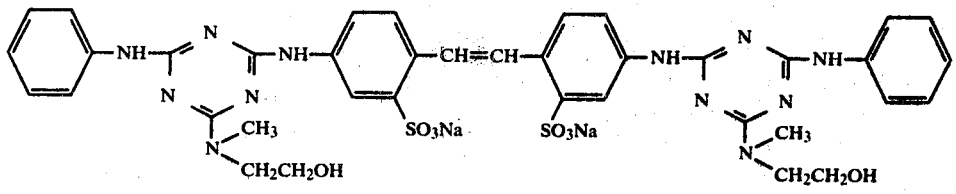

A-29

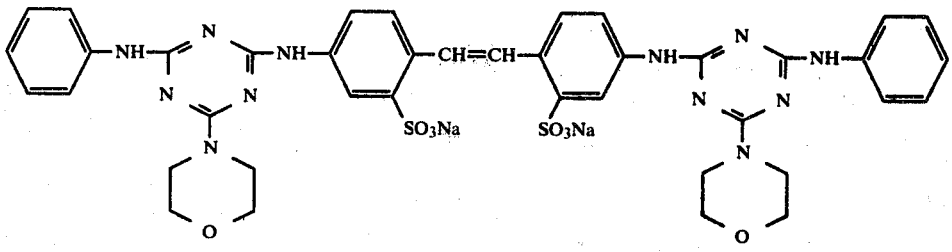

A-30

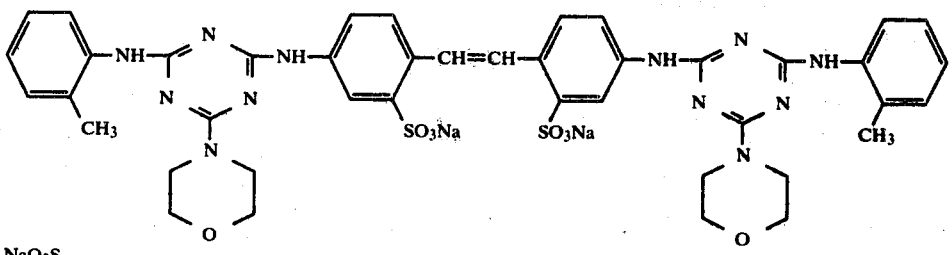

A-31

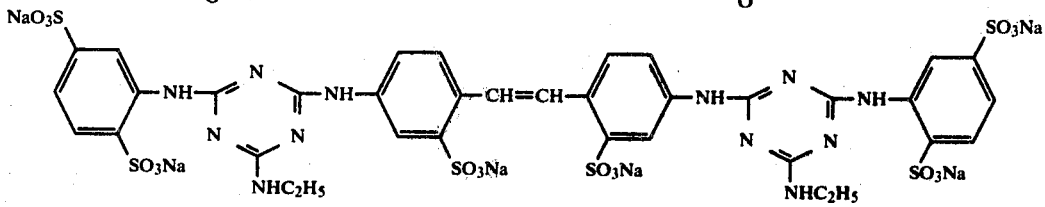

A-32

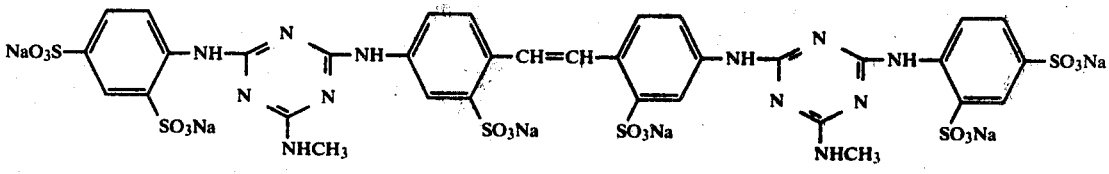

A-33

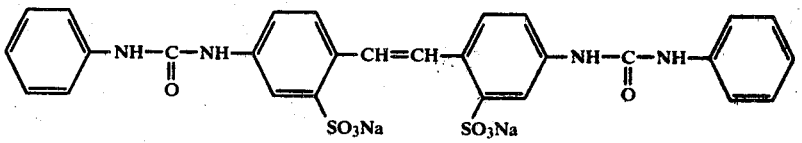

A-34

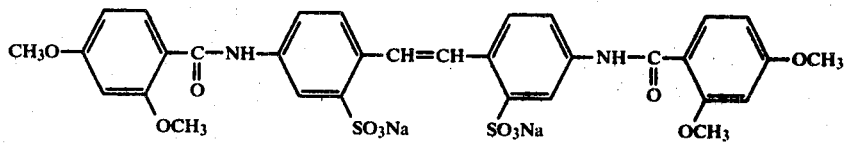

A-35

The 4,4'-diaminostilbenedisulfonic acid derivatives can be synthesized by a usual method as described in "Fluorescent Whitening Agents," compiled by the Institute of the Chemical Product Industry, (published on August, 1976), page 8.

The compounds of the general formula (I) or (II) are those indicated below, which are shown only by illustration, not for limitation.

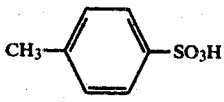

B-1

-continued

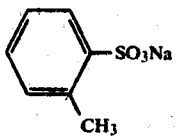

B-2

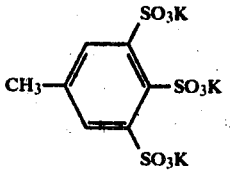

B-3

-continued

B-4 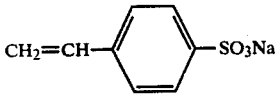

B-5 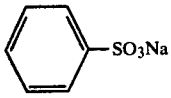

B-6 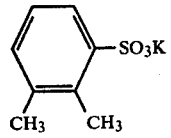

B-7 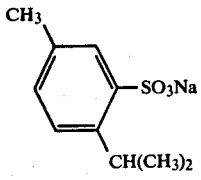

B-8 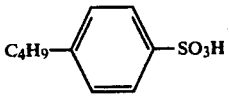

B-9 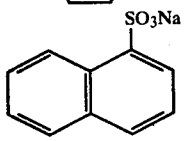

B-10 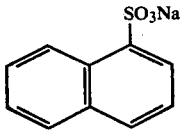

B-11 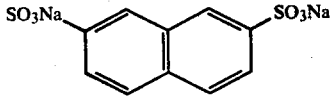

B-12 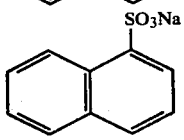

B-13 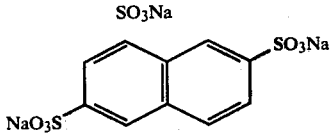

B-14 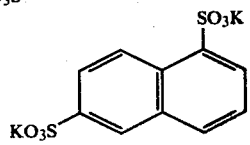

B-15 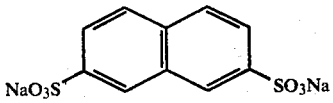

B-16 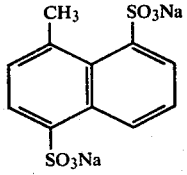

The compounds of the formula (I) or (II) as indicated above can be synthesized by any usual method such as described in "Organic Synthesis," Collective Volume 1, pages 492–494, the 11th Ed. (John Wiley & Sons Inc.)

It will be noted here that addition of a whitening agent to the photographic processing solution has been known, for example, in Japanese Post-Exam Patent Publication Nos. 46-35240 and 49-20975, and Japanese Pre-Exam Patent Publication No. 48-85232 but the whitening agent is added to proof the UV ray or to attain a whitening effect of the photosensitive material in any cases. It will be also noted that though there has been known from Japanese Pre-Exam Patent Publication No. 48-64933 a color developing solution which contains therein p-toluenesulfonic acid in the form of a salt of p-phenylenediamine, this sulfonic acid is added for the purpose of improving the solubility of p-phenylenediamine. In the sense, it is quite a novel fact that the combination of a p-toluenesulfonate and a 4,4'-diaminostilbenedisulfonic acid derivative produces an excellent anti-color stain effect.

The use of the 4,4'-diaminostilbenedisulfonic acid derivative in an amount of below 0.3 g per liter of the processing solution can not attain the purpose of the invention while an amount above 10 g will undesirably suppress the developing action of the processing solution or develop the quenching phenomenon, or produce unfavorable photographic results (inferiority in color reproduction). In order to achieve the purpose of the invention, the amount is thus in the range of 0.3–10 g per liter of the processing solution. Preferably, the amount should be in the range of 0.8–5 g per liter of the solution. The whitening agents may be used singly or in combination and, when used in combination, the total amount should be in the range of 0.3–10 g per liter of the processing solution.

The amount of the compound expressed by the general formula (I) or (II) may not be particularly limited. If, however, the compound is added in an amount above 50 g per liter of the developing solution, the solution will become inactive in its developing ability. While, when the compound is used in an amount above 50 g per liter of the bleach-fixing solution, the color reproduction of cyan dye may be adversely influenced in some cases. Accordingly, when the compound is preferably added in an amount of 1 g–50 g and most preferably 3 g–20 g per liter of the processing solution, good results can be obtained in the practice of the invention. The compounds of the formula (I) or (II) may be used in combination of two or more.

The 4,4'-diaminostilbenedisulfonic acid derivative and the compound expressed by the general formula (I) or (II) may be added either simultaneously to the color developing solution or bleach-fixing solution, or separately to the color developing solution and bleach-fixing solution.

In order to attain the purpose of the invention, the 4,4'-diaminostilbenesulfonic acid derivative may be added to either the color developing solution or the bleach-fixing solution in an amount of 0.3–10 g per liter of the solution. If necessary, however, the derivative may be further added to the other solution.

The manner of addition of the derivative and the compound of the formula (I) or (II) will be particularly shown below:

(1) (color developing solution + A) – (bleach-fixing solution + B)

(2) (color developing solution + A + B) – (bleach-fixing solution)
(3) (color developing solution + B) – (bleach-fixing solution + B)
(4) (color developing solution) – (bleach-fixing solution + A + B)
(5) (color developing solution + A + B) – (bleach-fixing solution + A + B)
(6) (color developing solution + A + B) – (bleach-fixing solution + A)
(7) (color developing solution + A) – (bleach-fixing solution + A + B)
(8) (color developing solution + A + B) – (bleach-fixing solution + B)
(9) (color developing solution + B) – (bleach-fixing solution + A + B)

In the above, "A" means a 4,4'-diaminostilbenedisulfonic acid derivative and "B" means a compound of the formula (I) or (II).

The principal color developing agent used for the color developing solution in the practice of the invention is an aromatic primary amine compound and, preferably, a p-phenylenediamine compound including, for example, 4-amino-N,N-diethylaniline, 3-methyl-4-amino-N,N-diethylaniline, 4-amino-N-ethyl-N-β-hydroxyethylaniline, 3-methyl-4-amino-N-ethyl-N-β-hydroxyethylaniline, 3-methyl-4-amino-N-ethyl-N-β-methanesulfonamidoethylaniline, 3-methyl-4-amino-N-ethyl-N-β-methoxyethylaniline, 3-β-methanesulfonamidoethyl-4-amino-N,N-diethylaniline, 3-methoxy-4-amino-N-ethyl-N-β-hydroxyethylaniline, 3-methoxy-4-amino-N-ethyl-N-β-methoxyethylaniline, 3-acetoamido-4-amino-N,N-diethylaniline, 4-amino-N,N-dimethylaniline, N-ethyl-N-β-[β-(β-methoxyethoxy)ethoxy]ethyl-3-methyl-4-aminoaniline, N-ethyl-N-β-(β-methoxyethoxy)ethyl-3-methyl-4-aminoaniline or a salt thereof such as, for example, sulfate, hydrochloride, sulfite, p-toluenesulfonate or the like.

These principal color developing agents are generally used in a concentration of about 0.1 g–about 30 g, preferably about 1 g–about 15 g, per liter of the color developing solution.

These principal color developing agents may be used singly or in combination of two or more and may be used in combination with a monochromic developer such as hydroquinone, if desired.

The color developing solution may further contain, aside from the above-mentioned principal color developer, a conventionally employed alkali additive such as, for example, sodium hydroxide, potassium hydroxide, ammonium hydroxide, sodium carbonate, potassium carbonate, sodium sulfate, sodium metaborate, borax or the like. Further, various additives may be added to the solution including, for example, benzyl alcohol, an alkali metal halide such as potassium bromide, a development controller such as citrazinic acid, a preservative such as sulfite, and a chelating agent such as a phosphate including polyphosphate, nitrilotriacetic acid, aminopolycarboxylic acids such as 1,3-diamino-2-propanol tetraacetate, hydroxycarboxylic acids such as citric acid, gluconic acid or the like, 1-hydroxyethylidene-1,1-diphosphonic acid, amino-tri(methylenephosphonic acid) or the like. The color developing solution is controlled to have a pH in the range of above 7, preferably about 9 to about 13.

Various types of bleaching agents are usable in the bleach-fixing solution according to the invention. Typical of such agents are, for example, metal complexes of organic acids which serve to convert metal silver produced by the development into a silver halide by oxidation and simultaneously act on a coloring agent in a non-colored area to allow the development of a color and which have a structure of coordinate metal ions such as iron, cobalt, copper or the like with an organic acid such as an aminopolycarboxylic acid, oxalic acid, citric acid or the like. Most preferably organic acids useful for forming the metal complexes of the acids are aminopolycarboxylic acids expressed by the following general formula (IV) or (V):

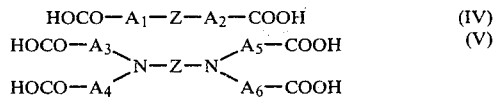

$$HOCO-A_1-Z-A_2-COOH \quad (IV)$$

$$\begin{matrix} HOCO-A_3 \\ HOCO-A_4 \end{matrix} \!\!> N-Z-N <\!\!\! \begin{matrix} A_5-COOH \\ A_6-COOH \end{matrix} \quad (V)$$

(wherein $A_1$, $A_2$, $A_3$, $A_4$, $A_5$ and $A_6$ are individually a hydrocarbon group with or without a substituent, and Z is a hydrocarbon group, oxygen, sulfur or $>N-A_7$ (in which $A_7$ is a hydrocarbon group or a lower aliphatic carboxylic acid)).

These aminopolycarboxylic acids may be in the form of metal salts, ammonium salts or water-soluble amine salts. Typical examples of the aminopolycarboxylic acids of the general formula (IV) or (V) or other aminopolycarboxylic acids are as follows: ethylenediaminetetraacetic acid, diethylenetriamine-pentaacetic acid, ethylenediamine-N-(β-hydroxyethyl)-N,N', N'-triacetic acid, propylenediamine-tetraacetic acid, nitrilotriacetic acid, cyclohexanediamine-tetraacetic acid, iminodiacetic acid, dihydroxyethylglycine, ethyletherdiamine-tetraacetic acid, glycolether-diamine-tetraacetic acid, ethylenediamine-tetrapropionic acid, phenylenediamine-tetraacetic acid, disodium ethylenediaminetetraacetate, tetra(trimethylammonium) ethylenediaminetetraacetate, tetrasodium ethylenediaminetetraacetate, pentasodium diethylenetriamine-pentaacetate, sodium ethylenediamine-N-(β-hydroxyethyl)-N,N', N'-triacetate, and sodium propylenediamine-tetraacetate.

The bleach-fixing solution useful in the present invention should contain, apart from the metal complex (e.g. iron complex) of the above-mentioned organic acid, a silver halide-fixing agent such as a thiosulfate, thiocyanate, or thiourea. Aside from the bleaching agent and the silver halide-fixing agent, the bleach-fixing solution may further contain a small amount of a halide compound such as potassium bromide. Alternatively, the bleach-fixing solution may contain a large amount of a halide compound such as potassium bromide. Still alternatively, there may be used a bleach-fixing solution of the specific type which contains, in combination, a bleaching agent and large amount of a halide compound such as potassium bromide. As the halide compounds other than potassium bromide, there may be used hydrochloric acid, hydrobromic acid, lithium bromide, sodium bromide, ammonium bromide, potassium iodide, ammonium iodide and the like.

The silver halide-fixing agent which is contained in the bleach-fixing solution is a compound which is generally employed for the fixing treatment and is capable of forming a water-soluble complex by reaction with a silver halide. Examples of such compound include thiosulfates such as potassium thiosulfate, sodium thiosulfate, ammonium thiosulfate, etc., thiocyanates such as potassium thiocyanate, sodium thiocyanate, ammonium thiocyanate, etc., thiourea, and bromides and iodides with high concentration of thioether.

The bleach-fixing solution may further contain, singly or in combination, various types of salts, serving as a pH buffering agent, including boric acid, borax, sodium hydroxide, potassium hydroxide, sodium carbonate, potassium carbonate, sodium bicarbonate, potassium bicarbonate, acetic acid, sodium acetate, ammonium hydroxide, etc. Further, various types of defoaming agents or surface active agents may be added to the solution. To the solution may be still further added a preservative such as a bisulfite addition compound e.g. hydroxylamine, hydrazine, or an aldehyde compound, an organic chelating agent such as an aminopolycarboxylic acid, a stabilizer such as a nitro alcohol nitrate, and an organic solvent such as methanol, dimethylformamide, dimethyl sulfoxide or the like.

The process according to the invention should preferably be applied to a treating process in which the bleach-fixing treatment is conducted immediately after the color development. The reason for this is not only due to simplification of the treating process, but also due to the fact that such treating process markedly involves the afore-discussed defects such as of color or edge stain and that the effect of the present invention becomes more pronounced in such treating process as compared with the case where water-washing and rinsing processes are conducted after the color development. It will be appreciated that processes of first monochromatic development, suspension and water-washing may be optionally conducted prior to the color development and, after the bleach-fixing process, usual treating processes such as water-washing, stabilization, stain removal, drying, etc. may be carried out.

The silver halide color photographic photosensitive material suitable for the process of the invention is comprised of at least one silver halide photosensitive layer coated on a support. The silver halide emulsion can be prepared by dispersing a photosensitive silver halide such as silver chloride, silver iodide, silver chloroiodide, silver bromide, silver iodobromide or silver chloroiodobromide in a hydrophilic colloidal binder. Examples of the hydrophilic colloids are proteins (gelatin, colloidal albumin, casein, etc.), cellulose derivatives (carboxymethyl cellulose, hydroxyethyl cellulose, etc.), polysaccharides (agar, sodium alginate, starch, etc.), and hydrophilic synthetic resin colloids (e.g. polyvinyl alcohol, poly-N-vinylpyrrolidone, polyacrylic acid, polyacrylamide, etc.)

The silver halide emulsion can be prepared by mixing a water-soluble silver salt (e.g. silver nitrate) with a water-soluble halide (e.g. potassium bromide) in the presence of water and a hydrophilic colloid according to any of well-known methods (including, for example, a single jet method, a double jet method and a controlled double jet method), and then physically or chemically aged (such as, for example, by a gold sensitization or a sulfur sensitization).

To the silver halide emulsion may be added, during the production process or immediately before application, various additives including a sensitizing dye, a stabilizer (e.g. 4-hydroxy-6-methyl-1,3,3a,7-tetrazaindene), a hardening agent (e.g. an aldehyde compound such as formalin, glyoxal or the like, or a nonaldehyde compound such as mucochloric acid, 2-hydroxy-4,6-dichloro-s-triazine or the like), and a coating aid (e.g. saponin, sodium laurylsulfate, dodecylphenol, polyethylene oxide ether, hexadecyltrimethylammonium bromide or the like). Of these, the saponin active coating aid is preferably used.

In general, the average particle size of the silver halide contained in the thus obtained emulsion is in the range of 0.1–2.0$\mu$, and preferably 0.2–1.5$\mu$.

The silver halide emulsion is then applied onto a support such as a glass plate, baryta paper, resin-coated paper, cellulose acetate film, or polyethylene terephthalate film by a known method such as dip method, air knife method, bead cord method, or an extrusion doctor method.

The applied silver halide photosensitive layer is usually composed of three layers (i.e. a blue light-sensitive layer, a green light-sensitive layer and a red light-sensitive layer).

Among these layers, at least one layer may be separated into two layers, if necessary. For instance, the green light-sensitive layer is, in some case, separated into two layers of high and low sensitivities. If necessary, a protective layer (uppermost layer), and intermediate layers including a filter layer, an antihalation layer and a backing layer) may be provided.

The silver halide color photosensitive material may be applied with various types of couplers, typical of which mentioned are an open-chain keto-methylene coupler as a yellow coupler, and compounds of pyrazolone, pyrazolotriazole, pyrazolinobenzimidazole and imidazolone types as a magenta coupler. Further, phenol or naphthol compounds may be used as a cyan coupler. In addition, there may be used a colored magenta coupler, colored cyan coupler, development inhibitor-releasing coupler or substance, Weiss (or colorless) coupler and competing coupler.

As ultraviolet absorbers, there may be used tinubins as described in Japanese Post-Exam Patent Publication Nos. 48-763 and 48-41572. Further, other various additives such as a fluorescent whitening agent, image stabilizer, antioxidant, lubricant, metal ion-blocking agent, emulsifier or dispersant may be used.

Any silver halide color photographic photosensitive materials such as color paper and reverse color paper may be used in the practice of the invention.

The anti-stain effect according to the invention becomes remarkable especially when there is used a color developing solution which contains a water-soluble organic solvent such as benzyl alcohol as a developer component.

The present invention will be particularly illustrated by way of the following examples, which should not be construed a limitation thereof.

EXAMPLE 1

The layers indicated below were formed on polyethylene-coated paper in the order mentioned as viewed from the support to give a silver halide color photographic photosensitive material.

The polyethylene-coated paper to be used as a support was obtained by mixing 200 parts by weight of polyethylene with an average molecular weight of 100,000 and a density of 0.95 with 20 parts by weight of polyethylene with an average molecular weight of 2,000 and a density of 0.80, to which 6.8 wt % of anatase type titanium dioxide was added, and then applying the resulting mixture onto the surface of a high quality paper of a weight of 170 g/m$^2$ on one surface thereof by an extrusion coating technique to have a coating layer of 0.035 mm in thickness. Further, the opposite surface of the paper was coated with polyethylene alone to form a 0.040 mm thick coating layer. The polyethylene-coated surface layer of the support thus prepared was pretreated by corona discharge and then the following layers were applied thereonto.

First Layer:

A blue light-sensitive silver halide layer formed from a silver chlorobromide emulsion containing 95 mole % of silver bromide. The emulsion contained 350 g of gelatin per mole of the silver halide, and had been sensitized with 2.5 moles, per mole of the silver halide, of a sensitizing dye of the following structural formula

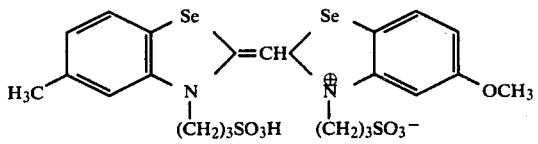

(isopropyl alcohol being used as a solvent for this), and it further contained $2\times10^{-1}$ moles of each of 2,5-di-t-butylhydroquinone and of a yellow coupler, α-[4-(1-benzyl-2-phenyl-3,5-dioxo-1,2,4-triazolidyl)]-α-pivalyl-2-chloro-5-[γ-(2,4-di-t-amylphenoxy)-butylamido]acetoanilide, per mole of the silver halide, both of which were dissolved in butyl phthalate and dispersed in the emulsion. The emulsion was applied so as to have the coated silver amount of 350 mg/m².

Second Layer:

A gelatin layer containing 300 mg/m² of di-t-octylhydroquinone dissolved in dibutyl phthalate and dispersed in gelatin and 200 mg/m² of a mixture, serving as an ultraviolet absorber, of 2-(2'-hydroxy-3',5'-di-t-butylphenyl)benzotriazole, 2-(2'-hydroxy-5'-t-butylphenyl)-benzotriazole, 2-(2'-hydroxy-3'-t-butyl-5'-methylphenyl)-5-chlorobenzotriazole, and 2-(2'-hydroxy-3',5'-di-t-butylphenyl)-5-chloro-benzotriazole, and having a gelatin content of 2,000 mg/m².

Third Layer:

A green light-sensitive silver halide layer formed from a silver chlorobromide emulsion containing 85 mole % of silver bromide, the emulsion further comprising, per mole of the silver halide, 450 g of gelatin, $2.5\times10^{-4}$ mole of a sensitizing dye of the following structural formula

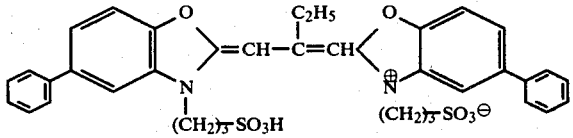

and $1.5\times10^{-1}$ moles of 2,5-di-t-butylhydroquinone and of magenta coupler-1-(2,4,6-trichlorophenyl)-3-(2-chloro-5-octadecenylsuccinimidoanilino)-5-pyrazolone, both of which were dissolved in a mixed solvent of dibutyl phthalate and tricresyl phosphate in a mixing ratio of 2:1 and dispersed in the emulsion. The emulsion was coated so as to have the silver amount of 400 mg/m². Further, 2,2,4-trimethyl-6-laurylhydroxy-7-t-octylchroman was used as an antioxidant in an amount of 0.5 mole per mole of the coupler.

Fourth Layer:

A gelatin layer containing 30 mg/m² of di-t-octylhydroquinone dissolved in dibutyl phthalate and dispersed in the gelatin and 500 mg/m² of a mixture, serving as an ultraviolet absorber, of 2-(2'-hydroxy-3',5'-di-t-butylphenyl)benzotriazole, 2-(2'-hydroxy-5'-t-butylphenyl)-benzotriazole, 2-(2'-hydroxy-3'-t-butyl-5'-methylphenyl)-5-chlorobenzotriazole, and 2-(2'-hydroxy-3',5'-t-butylphenyl)-5-chloro-benzotriazole (2:1.5:1.5:2), the gelatin being coated in an amount of 2,000 mg/m².

Fifth Layer:

A red light-sensitive silver halide layer formed from a silver chlorobromide emulsion containing 85 mole % of silver bromide, the emulsion containing, per mole of the silver halide, 500 g of gelatin, $2.5\times10^{-4}$ mole of a sensitizing dye of the following structural formula

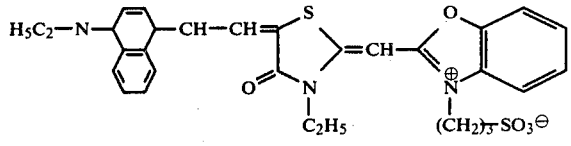

and $3.5\times10^{-1}$ mole of 2,5-di-t-butylhydroquinone and 2,4-dichloro-3-methyl-6-[γ-(2,4-diamylphenoxy)-butylamido]-phenol cyan coupler. The emulsion was applied so as to have the silver amount of 270 mg/m².

Sixth Layer:

A gelatin layer applied so as to have the gelatin amount of 1,000 mg/m².

The silver halide emulsions used to form the respective photosensitive layers (i.e. the first, third and fifth layers) were each prepared according to the method described in Japanese Post-Exam Patent Publication No. 46-7772. Each of the emulsions was chemically sensitized with sodium thiosulfate pentahydrate and was incorporated with 4-hydroxy-6-methyl-1,3,3a,7-tetrazaindene as a stabilizer, bis(vinylsulfonylmethyl)ether as a hardening agent, and saponin as a coating aid.

The samples prepared according to the above procedures were exposed to light by the use of an automatic printer (Sakura Color Printer Model 5NS, available from Konishiroku Photo Industry Co., Ltd.), developed by means of an automatic developing machine (Color Roll Processor Model RP-1180SRC, available from Noritsu Steel Machine Co., Ltd.), and subjected to a running process for 100 hours to observe developments of magenta stain on white portions of the sample and edge stain.

| Processing Steps by Automatic Developing Machine | | Processing Temperature (°C.) | Processing Time (min) |
|---|---|---|---|
| 1. | Color development | 33 ± 0.3 | 3.5 |
| 2. | Bleach-fixing | 30–34 | 1.5 |
| 3. | Water-washing | 30–34 | 3.5 |
| 4. | Drying | 75–85 | |

During the course of the processing, the color development and bleach-fixing were conducted in such a manner that a color developing replenisher and a regenerated bleach-fixing replenisher were continuously supplemented at a rate of 325 ml, respectively, whenever 1 m² of the sample was processed. The color development replenisher and color developing solution employed had the compositions as described below.

Color development replenisher:

The following four compositions (1), (2), (3) and (4) were successively added to a suitable amount of pure water, followed by mixing and dissolving to make total 1 l, by which 1 l of a color development replenisher for color paper was obtained. An amount required for the processing was appropriately prepared and used.

| | | |
|---|---|---|
| Composition (1): | | |
| Benzyl alcohol | | 20 ml |
| Ethylene glycol | | 20 ml |
| Additive A (4,4'-diaminostilbene-disulfonic acid derivative as whitening agent | | 2 g |
| Water to make up | total | 50 ml |
| Composition (2): | | |
| Hydroxylamine sulfate | | 4 g |
| Additive B (compound of the general formula (I) or (II) of the invention) | | 7 g |
| Composition (3): | | |
| 3-Methyl-4-amino-N-ethyl-N-(β-methanesulfonamidoethyl)aniline sulfate | | 7 g |
| Composition (4): | | |
| Potassium carbonate | | 30 g |
| 1-Hydroxyethylidene-1,1-phosphonic acid (60% solution) | | 1.1 ml |
| Potassium sulfite (50% solution) | | 5 ml |
| Potassium hydroxide | | 3 g |
| Water to make up | total | 50 ml |

The replenisher solution may be lowered in pH depending on the additives, and so a suitable amount of potassium hydroxide is to be added to adjust its pH to 10.45 when the total amount is made 1 l by suitable addition of water.

Color developing solution:

A color development starter of the following formulation was added to 800 ml of the color development replenisher, to which a suitable amount of water was added to make 1 l of a color developing solution with a pH of 10.20. The developing solution was prepared and used in an amount required for the processing.

Color developing starter:

| | |
|---|---|
| Potassium carbonate | 2.2 g |
| Potassium bicarbonte | 3.4 g |
| Potassium bromide | 0.64 g |
| Potassium chloride | 0.50 g |

The bleach-fixing solution and bleach-fix regenerating solution are as follows.

Bleach-fixing solution:

| | | |
|---|---|---|
| Composition (5) | | |
| Ethylenediaminetetraacetic acid | | 40 g |
| Ammonium sulfite (50% solution) | | 30 ml |
| Ammonium thiosulfate (70% solution) | | 140 ml |
| Aqueous ammonia (28% solution) | | 30 ml |
| Water to make up | total | 250 ml |
| Composition (6) | | |
| Sodium iron (III) ethylenediaminetetraacetate | | 70 g |

The bleach-fixing solution was prepared by successively dissolving the compositions (5) and (6) and adding aqueous ammonia and acetic acid to adjust the pH of the solution to 7.10. A suitable amount of water added to the solution to have a total amount of 1 l.

The bleach-fixing solution was used as a bleach-fixing replenisher on the running and starting operations, after which the regenerated bleach-fixing replenisher was used.

Bleach-fix regenerating solution:

| | | |
|---|---|---|
| Ethylenediaminetetraacetic acid | | 250 g |
| Ammonium sulfate (50% solution) | | 140 ml |
| Ammonium thiosulfate (70% solution) | | 350 ml |
| Aqueous ammonia (28% solution) | | 95 ml |
| Water to make up | total | 1 l |

One liter of the bleach-fixing solution overflowed from the automatic developing machine into the Sakura Liflo Unit Model I (available from Konishiroku Photo Industry Co., Ltd.) to recover the silver. Thereafter, 150 ml of the solution was discharged and 850 ml of the remaining solution was appropriately aerated, to which 150 ml of the bleach-fix regenerating solution was added to give a regenerated bleach-fixing replenisher.

If foaming took place considerably upon the aeration, the Sakura defoamer No. 1 (CAF-1, product of Konishiroku Photo Industry Co., Ltd.) was applied. The water-washing was carried out by using 9 liters of water per $m^2$ of the photosensitive material.

The running process was effected for 100 hours in the manner as described above. For comparison, a running process in which the additive (A) and/or additive (B) was not used was also conducted. Further, two types of whitening agents indicated below which are not within the scope of the invention were used for comparison with the additive (A).

Comparative whitening agent (a-1)

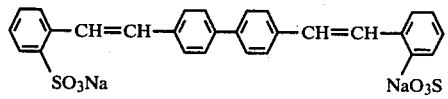

Comparative whitening agent (a-2)

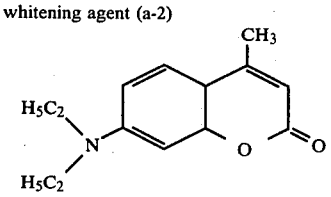

For comparison with the additive (B), a compound of the following formula was used:

Comparative additive (b-1)

$HO—C_4H_8—SO_3H$

These comparative compounds were used in combination with the compounds according to the invention.

In all the experiments, the developments of magenta stain and edge stain after the processing over 100 hours were observed with the following results shown in Table below.

TABLE

| | Sample No. | Additive (A) | Additive (B) | Evaluation of magenta stain | Evaluation of edge stain |
|---|---|---|---|---|---|
| 1. | For Comparison | nil | nil | 10 | 10 |
| 2. | For Comparison | nil | B-1 | 9 | 10 |
| 3. | For Comparison | A-3 | nil | 7 | 7 |
| 4. | Present invention | A-3 | B-1 | 0 | 0 |
| 5. | Present invention | A-1 | B-2 | 1 | 2 |
| 6. | Present invention | A-2 | B-3 | 2 | 3 |
| 7. | Present invention | A-5 | B-4 | 0 | 1 |

TABLE-continued

| | Sample No. | Additive (A) | Additive (B) | Evaluation of magenta stain | Evaluation of edge stain |
|---|---|---|---|---|---|
| 8. | Present invention | A-6 | B-1 | 1 | 0 |
| 9. | Present invention | A-13 | B-2 | 2 | 1 |
| 10. | Present invention | A-19 | B-1 | 1 | 1 |
| 11. | Present invention | A-1 | B-4 | 0 | 1 |
| 12. | Present invention | A-3 | B-11 | 0 | 1 |
| 13. | Present invention | A-4 | B-12 | 1 | 1 |
| 14. | Present invention | A-6 | B-13 | 1 | 2 |
| 15. | Present invention | A-5 | B-14 | 0 | 1 |
| 16. | Present invention | A-2 | B-15 | 2 | 1 |
| 17. | Present invention | A-2 and A-3 | B-1 and B-12 | 0 | 2 |
| 18. | Comparative experiment | A-1 | B-1 | 9 | 10 |
| 19. | Comparative experiment | A-2 | B-1 | 10 | 10 |
| 20. | Comparative experiment | A-1 | B-1 | 7 | 9 |

In the above Table, the values in the column of "Evaluation of magenta stain" are determined as follows: the figure "10" is the most considerable in magenta stain, smaller figures showing less degree of staining, and the figure "0" shows no occurrence of the magenta stain. The evaluation on the edge stain is similarly determined.

From the above Table, it will be understood that when the 4,4'-diaminostilbenedisulfonic acid derivatives and the compounds of the general formula (I) or (II) are used singly, no significant effect can be attained. Surprisingly, the combinations of the compounds of the general formula (I) or (II) and the 4,4'-diaminostilbenedisulfonic acid derivatives have been found to almost completely control the magenta and edge stains.

EXAMPLE 2

The running test was conducted in the same manner as in Example 1 except that the additives (A) and/or the additives (B) in the color developing solution were added to the bleach-fixing solution, with the results similar to those of Example 1.

EXAMPLE 3

The bleach-fixing step of Examples 1 and 2 was changed as follows and similar results were obtained.

Bleach-fixing solution:

| | |
|---|---|
| Composition (7) | |
| Ammonium thiosulfate (70% solution) | 150 ml |
| Composition (8) | |
| Sodium iron (III) ethylenediaminetetraacetate | 45 g |
| Sodium sulfite | 10 g |

The compositions (7) and (8) were successively dissolved, to which aqueous ammonia and acetic acid were added to adjust its pH to 6.8. Water was added to the solution to have a total amount of 1 liter.

Bleach-fix regenerating Agent:

| | |
|---|---|
| Composition (9) | |
| Ammonium thiosulfate (70% solution) | 45 ml |
| Composition (10) | |
| Sodium iron (III) ethylenediaminetetraacetate | 16 g |
| Sodium sulfite | 12 g |

Of 1 l of the bleach-fixing solution overflowed from the automatic developing machine, the 150 ml portion was subjected to recovery of silver and then discharged. To 850 ml of the remaining solution were successively added the above-indicated compositions (9) and (10), to which were further added aqueous ammonia and acetic acid to adjust its pH to 6.2 and also a suitable amount of water to make a total 1 l thereby giving a regenerated bleach-fixing replenisher.

EXAMPLE 4

The fixing step of Examples 1 and 2 was changed as follows, with similar results.

The bleach-fixing solution was prepared by successively dissolving the compositions (7) and (8), to which aqueous ammonia and acetic acid were added to adjust its pH to 6.8 and water was also added to make a total of 1 l. The bleach-fixing solution was not regenerated and three types of bleach-fixing replenishers indicated below were supplemented from separate systems. The bleach-fixing replenisher (E) was intermittently used according to the pH of the bleach-fixing running solution.

Bleach-fixing replenisher (C):

Ammonium thiosulfate (70% solution)

Bleach-fixing replenisher (D):

| | | |
|---|---|---|
| Sodium iron (III) ethylenediaminetetraacetate | | 170 g |
| Ammonium sulfite (50% solution) | | 210 ml |
| Water to make up | total | 1 l |

Bleach-fixing replenisher (E)

Acetic acid (25% solution)

The bleach-fixing replenishers were supplemented in such a manner that 14.4 ml of the replenisher (C) and 30.4 ml of the replenisher (D) were, respectively, added whenever 1 $m^2$ of the photosensitive material was processed and the replenisher (E) was added to keep the pH of the bleach-fixing running solution at about 6.2. The overflowed solution of the bleach-fixing solution was subjected to silver recovery and then discharged without regeneration.

EXAMPLE 5

Examples 1 to 4 were repeated except that the amount of the additives (A) was changed to 4 g per liter of the treating solution and that of the additives (B) was changed to 4 g per liter of the treating solution, with similar results.

EXAMPLE 6

Examples 1 to 4 were repeated using 1.2 g of the additives (A) per liter of the treating solution and 16 g of the additives (B) per liter of the treating solution, respectively, with similar results.

EXAMPLE 7

The procedure of Example 4 was repeated using a bleach-fixing replenisher (F) of the following formulation instead of the bleach-fixing replenishers (C), (D) and (E), with similar results.

Bleach-fixing replenisher (F)

| | | |
|---|---|---|
| Ammonium thiosulfate (70% solution) | | 300 ml |
| Ammonium iron (III) ethylene-diaminetetraacetate | | 110 g |
| Ammonium sulfite (50% solution) | | 160 ml |
| | total | 1 l |

The above bleach-fixing solution (F) was adjusted to a pH of 5.8 by means of aqueous ammonia and acetic acid, and was supplemented in an amount of 48 ml whenever 1 $m^2$ of the photosensitive material was processed. The overflowed solution of the bleach-fixing solution was subjected to silver recovery and then discharged without regeneration.

EXAMPLE 8

Example 1 was repeated using color development replenishers of the formulations shown below, with similar results.

| | | |
|---|---|---|
| Composition (11) | | |
| Benzyl alcohol | | 6 ml |
| Diethylene glycol | | 20 ml |
| Additive (A) | | 2 g |
| Water to make up | total | 30 ml |
| Composition (12) | | |
| Hydroxylamine sulfate | | 4 g |
| Composition (13) | | |
| 3-Methyl-4-amino-N-ethyl-N-β-methoxyethylaniline di-p-toluenesulfonate (Example of adding the compound B-1 in the form of a salt of a color developing agent) | | 7 g |
| Composition (14) | | |
| Potassium carbonate | | 30 g |
| 1-Hydroxyethylidene-1,1-diphosphonic acid (60% solution) | | 2 ml |
| Potassium sulfite (50% solution) | | 5 ml |
| Potassium hydroxide | | 3.5 g |

-continued

| | | |
|---|---|---|
| Water to make up | total | 50 ml |

What we claim is:

1. In a process of developing an imagewise exposed silver halide color photographic photosensitive material with a color developing solution and then bleach-fixing with a bleach-fixing solution, the improvement which comprises adding, to at least one of the color developing solution and the bleach-fixing solution, at least one whitening agent selected from the group consisting of 4,4'-diaminostilbene-disulfonic acid derivatives and at least one additive selected from compounds of the following formulae (I) and (II):

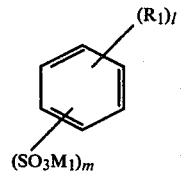

(I)

and

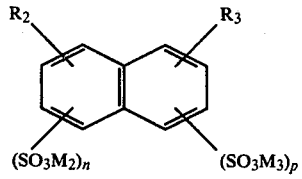

(II)

wherein $R_1$, $R_2$ and $R_3$ are individually hydrogen, an alkyl group or an alkenyl group, $M_1$, $M_2$ and $M_3$ are individually hydrogen or a cation, l and m are individually an integer of 1 to 3 inclusive, and n and p are individually an integer to satisfy an inequality of $1 \leqq n+p \leqq 8$.

2. A process according to claim 1, wherein the additive is selected from those of the formula (I).

3. A process according to claim 1, wherein the amount of the whitening agent in the solution is in the range of 0.8 to 5 grams per liter.

4. A process according to claim 3, wherein the color developing solution contains both the whitening agent and the additive.

5. A process according to claim 1, wherein the amount of the additive in the solutions is in the range of 1 to 50 grams per liter.

* * * * *